United States Patent [19]

Hornivius

[11] Patent Number: 5,005,316

[45] Date of Patent: Apr. 9, 1991

[54] PANE HOLDER MOUNTING SYSTEM FOR A WINDOW LIFT

[75] Inventor: Lothar Hornivius, Ehringshausen, Fed. Rep. of Germany

[73] Assignee: Kuster & Co., Ehringshausen, Fed. Rep. of Germany

[21] Appl. No.: 474,397

[22] Filed: Feb. 6, 1990

[30] Foreign Application Priority Data

Feb. 7, 1989 [DE] Fed. Rep. of Germany ..... 3903556

[51] Int. Cl.[5] ..... E05F 11/38

[52] U.S. Cl. ..... 49/348; 49/375

[58] Field of Search ..... 49/348, 349, 350, 351, 49/352, 353, 227, 374, 375

[56] References Cited

U.S. PATENT DOCUMENTS

| | | | |
|---|---|---|---|
| 3,442,050 | 5/1969 | Zoltok | 49/349 |
| 4,442,632 | 4/1984 | Greco et al. | 49/352 |
| 4,706,412 | 11/1987 | Kobrehel | 49/352 |
| 4,753,125 | 6/1988 | Fukumoto et al. | 49/352 X |

*Primary Examiner*—Philip C. Kannan

*Attorney, Agent, or Firm*—Longacre & White

[57] ABSTRACT

A window lift including a multi adjustable window pane holder mounting mechanism. The mounting mechanism provides for lateral, longitudinal, and tilting movement between the window pane holder and the guide rail of the window lifting mechanism. An alternative embodiment also provides for rotational movement between the mounting pin for the window pane holder and the window pane holder.

6 Claims, 2 Drawing Sheets

PANE HOLDER MOUNTING SYSTEM FOR A WINDOW LIFT

FIELD OF THE INVENTION

The invention relates to the field of window lifts. More specifically, the invention relates to a cable operated type window lift for vehicular mounted windows. The mechanism comprises an adjustable mount which compensates for variable assembly and operational tolerances in several mutually distinct planes. The adjustable assembly includes a mounting post connected to the pane holder by a slidable and moderately rotatable slide block.

BACKGROUND OF THE INVENTION

There exists several prior art window pane mounting mechanisms. Some of these prior art mounting systems include adjustable features to accommodate assembly and operational tolerances of the lift mechanism which may vary and provide for problematic window lift operation. However, the range of adjustment in the prior art systems is usually quite limited.

An example of the prior art window lift mounting systems is disclosed in German Offenlegungsschrift No. 37 27 153. The mechanism disclosed in this document includes an eccentric mounting bolt which is mounted through an elongated slot in the mounting plate. This mounting arrangement provides for transverse and height adjustment of the mounting plate including the slot. The mounting plate is, in turn, mounted to the pane holder.

The present invention mounting system provides for the additional tilting of the pane holder with respect to the guide rail of the window lift mechanism. Also, a window lift mechanism according to the present invention provides for lateral and longitudinal adjustment of the window pane holder with respect to the guide rail.

SUMMARY OF THE INVENTION

The window lift mechanism according to the present invention comprises a window lift slide element which moves along a rail. A mounting pin for the window pane holder is fixedly attached to the window facing side of the slide element. A window pane holder element is attached to the mounting pin by a partially spherically shaped bushing which is also capable of moving longitudinally along the pin and transversely with respect to the window pane holder element.

The partial spherical shape to the mounting bushing located between the window pane holder and the mounting pin enables the window pane holder to tilt with respect to the guide rail in a plane which is orthogonal to the guide rail. Combining the tilting movement of the pane holder with the longitudinal movement of the bushing along the pin and the lateral movement of the bushing within the slotted window pane holder element, provides a good range of adjustability between the window pane holder element and the guide rail slide element.

A further embodiment of the invention includes the provision of a cylindrical shape for the mounting pin so that the window pane holder element can also rotate in a plane tiltable with respect to the axis of the mounting pin.

The foregoing, as well as other features of the present invention, will become apparent to one of skill in this art by a reading of the accompanying specification and drawings which form a part thereof.

DETAILED DESCRIPTION OF THE PREFERRED EMBODIMENTS

Figure 1:
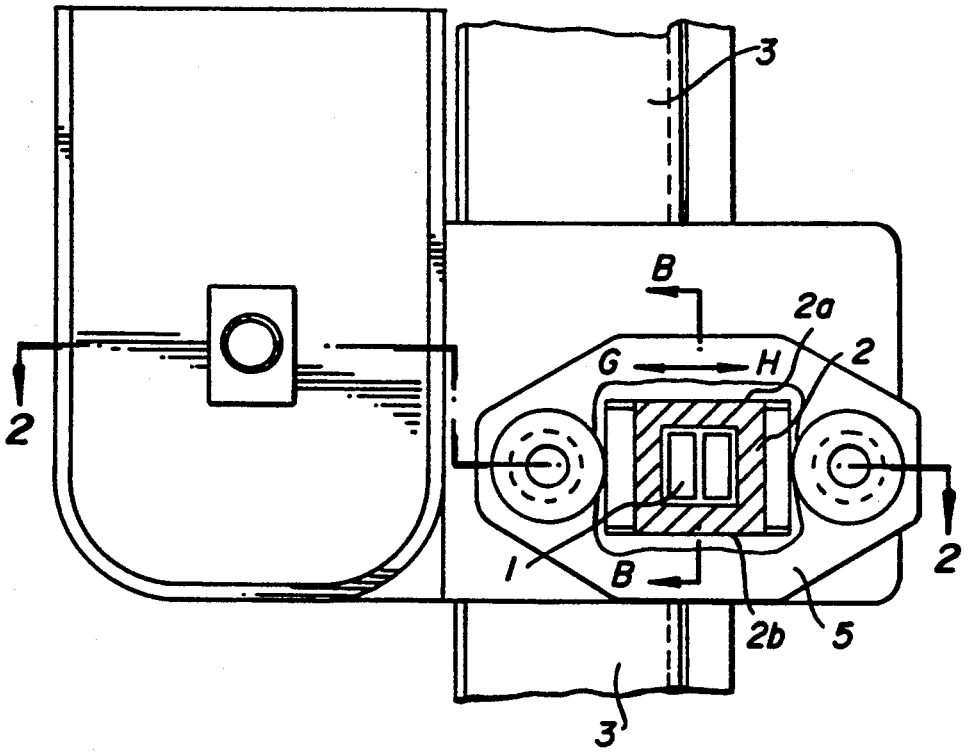
FIG. 1 is an elevational view of a window lift mechanism according to the present invention.
Figure 1A:
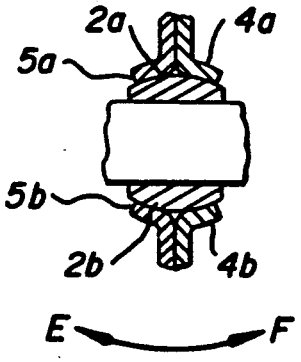
FIG. 1A is cross sectional view of the bushing assembly of the present invention along section B—B of FIG. 1.
Figure 2:
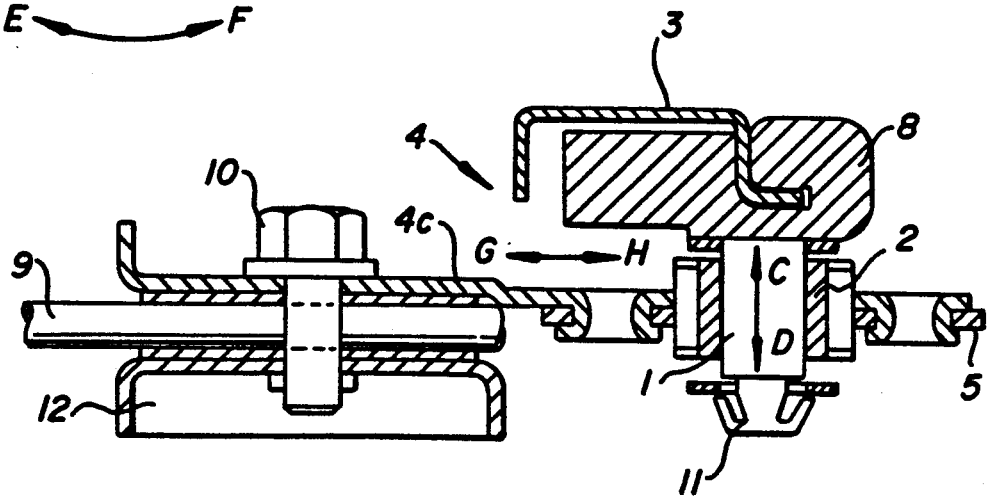
FIG. 2 is a cross sectional view of a window lift mechanism according to the present invention along section II—II of FIG. 1.

The embodiment of the invention disclosed in FIGS. 1, 1*a*, and 2 is applied to a bowden cable type window lift. The lift mechanism is comprised of a slider element 8 which is pulled along a guide rail 3 by a cable (unmarked).

A mounting pin 1 projects from the slider element 8 and serves as an attachment structure for the window pane holder element 4. The holder element 4 is attached to a plate element 5 by rivets, for example, so that the connection between the plate 5 and holder element 4 is secure. The combination of elements 4 and 5 is attached to mounting pin 1 by means of a slide block bushing element 2.

The bushing 2 seats along the pin 1 so as to allow longitudinal (direction C–D in FIG. 2) movement along the pin. The bushing element 2 is kept on the pin by securing disk 11. In this way, the bushing element cannot be inadvertently pulled off the end of the pin 1.

The connection of the bushing element 2 to window pane holder elements 4 and 5 is accomplished as shown in FIG. 1A. The bushing element 2 includes rounded end portions 2*a* and 2*b*. These end portions engage and tilt between a pair of complimentary curved surfaces formed on the inner edges 4*a* and 4*b*, and 5*a* and 5*b* of a slot formed in elements 4 and 5 respectively. These curved inner edges in combination with the curved end portions of bushing 2 enable the bushing to tilt (direction E–F in FIG. 1A) with respect to the axes of pin 1 and the supporting guide rail 3.

The curved inner surfaces 4*a*, 4*b*, 5*a*, and 5*b* together form oppositely positioned troughs which extend laterally longer than the length dimensions of the curved surfaces of bushing 2. In this manner, the bushing 2 is able to move laterally (direction G–H in FIGS. 1 and 2) within the slot formed by the combined curved surfaces of elements 4 and 5.

The pane holder element 4 is therefore able to automatically adjust itself in the following directions during assembly: Firstly, the pane holder may adjust itself in a direction normal to the guide rail and along the axis of pin 1 (i.e., in direction C– D). Next, the pane holder can adjust laterally with respect to the guide rail by moving within the slot provided in the connection between elements 4 and 5. Finally, the window pane holder may tilt with respect to the axes of the mounting pin and the guide rail by rotating along the curved mating surfaces between elements 4, 5, and 2 (see FIG. 1A).

Figure 3:
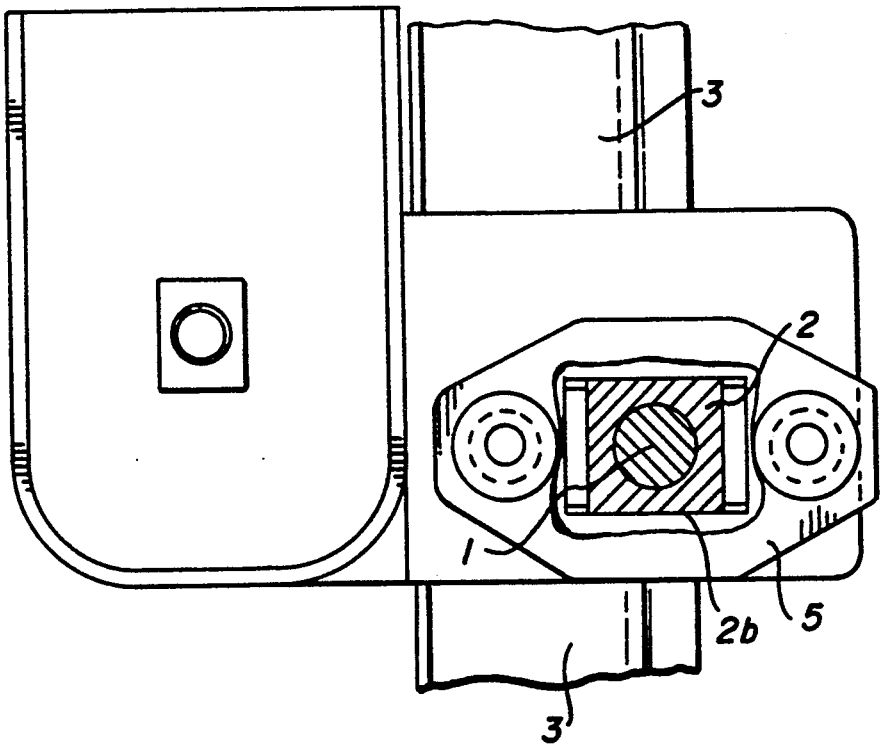
FIG. 3 is a cross sectional view of another embodiment of a window lift mechanism according to the present invention.

Pin 1 is shown in the drawing figures in a rectangular cross section. Owing to this configuration, the pane holder elements 4 and 5 cannot rotate about the axis of mounting pin 1. However, to accommodate the desirability of rotation of the pane holder 4 about the axis of pin 1, the pin may be of rounded cross section as shown in FIG. 3. This embodiment may, of course, include the rounded inner surfaces of the mounting plates and the curved bushing edge portions of the embodiment disclosed in the drawings so that the pane holder is tiltable with respect to the axis of the guide rail and mounting pin 1.

Further improvements to the disclosed invention may occur to a person of skill in this art, hence the following claims are intended to include within their scope such improvements.

I claim:

1. A window lift mechanism comprising:

a slide block for lifting a window, said block slidingly engaging a guide rail;

a mounting pin for a window pane holder attached to said slide block;

a bushing interposed between said window pane holder and said mounting pin, said bushing including rounded outer edge portions which engage similarly rounded inner surface portions of a slot located in said window pane holder, the combination of said rounded inner and outer surface and edge portions allowing limited tilting to occur between said window pane holder and said bushing with respect to the axis of said mounting pin.

2. A window lift mechanism as claimed in claim 1, wherein:

said bushing is dimensioned so as to be shorter in longitudinal dimension than the longitudinal dimension of said mounting pin, thereby providing limited longitudinal axial movement between said bushing and said pin.

3. A window lift mechanism as in claim 2, wherein:

said slot located in said window pane holder is of greater lateral dimension than the lateral dimension of said bushing, thereby allowing limited lateral movement between said window pane holder and said bushing.

4. A window lift mechanism as in claim 3, wherein:

said mounting pin is of rounded cross section and a portion of said bushing which engages the rounded portion of said pin is similarly rounded whereby relative rotation may occur between said mounting pin and said bushing.

5. A window lift mechanism as in claim 1, wherein:

said slot located in said window pane holder is of greater lateral dimension than the lateral dimension of said bushing, thereby allowing limited lateral movement between said window pane holder and said bushing.

6. A window lift mechanism as in claim 5, wherein:

said mounting pin is of rounded cross section and a portion of said bushing which engages the rounded portion of said pin is similarly rounded whereby relative rotation may occur between said mounting pin and said bushing.

* * * * *